US006779936B1

(12) United States Patent
Martin

(10) Patent No.: US 6,779,936 B1
(45) Date of Patent: Aug. 24, 2004

(54) ONE-SIDED PRINTING AND MANUFACTURING OF A MÖBIUS STRIP

(76) Inventor: Ross Daniel Martin, 320 Strawberry Hill Ave., Unit 54, Stamford, CT (US) 06902

( * ) Notice: Subject to any disclaimer, the term of this patent is extended or adjusted under 35 U.S.C. 154(b) by 0 days.

(21) Appl. No.: 09/980,233

(22) PCT Filed: May 25, 2000

(86) PCT No.: PCT/US00/14423

§ 371 (c)(1),
(2), (4) Date: Jun. 3, 2002

(87) PCT Pub. No.: WO00/71216

PCT Pub. Date: Nov. 30, 2000

Related U.S. Application Data

(60) Provisional application No. 60/136,062, filed on May 26, 1999.

(51) Int. Cl.[7] ..... A63F 9/08
(52) U.S. Cl. ..... 400/719; 273/155
(58) Field of Search ..... 273/155, 156; 400/630, 613, 621, 719

(56) References Cited

U.S. PATENT DOCUMENTS 4,735,418 A * 4/1988 Engel ..... 273/155
4,919,427 A * 4/1990 Keidar et al. ..... 273/155
5,324,037 A * 6/1994 Greeson ..... 273/155
6,182,565 B1 * 2/2001 Takayama et al. ..... 101/35

FOREIGN PATENT DOCUMENTS

DE 3439509 A * 4/1986 ..... A63F/9/06
JP 11047453 A * 2/1999 ..... A63H/33/00
RU 2038838 C1 * 7/1995 ..... A63F/9/08

OTHER PUBLICATIONS

Machine translation of JP 11047453 from Japanese Patent Office website.*

* cited by examiner

*Primary Examiner*—Daniel J. Colilla
(74) *Attorney, Agent, or Firm*—Peter F. Corless; Christine C. O'Day; Edwards & Angell, LLP

(57) ABSTRACT

The invention provides methods for the one sided printing and manufacture of a Möbius strip. The invention includes a method comprising providing an image (30); aligning three substantially identical copies of the image (30) such that a first copy is juxtaposed to a second copy, and a third copy is centered beneath and adjacent to the first and second copies; setting a die layout in a desired configuration; die cutting the Möbius strip using a die (29); and assembling the Möbius strip. Using methods of the invention, relatively seamless Möbius strips may be constructed for use in a wide variety of retail items, such as gift and other novelty items and as a marketing tool for organization wishing to promote cyclical concepts.

18 Claims, 12 Drawing Sheets

ONE-SIDED PRINTING AND MANUFACTURING OF A MÖBIUS STRIP

The present application claims the benefit of U.S. provisional application No. 60/136,062, filed May 26, 1999, which is incorporated herein by reference.

BACKGROUND OF THE INVENTION

1. Field of the Invention

The present invention relates to novel methods for the one-sided printing and manufacture of a Möbius strip. Methods of the invention are particularly well suited for constructing relatively seamless Möbius strips for use in a wide variety of retail items.

2. Background

August F. Möbius was a mathematician and astronomer in the 18th century who wrote extensively about what has now been named after him, the Möbius strip. The Möbius strip is a continuous one-sided surface that can be formed from a rectangular strip by rotating one end 180° and attaching it to the other end.

The Möbius strip has enjoyed a place of prominence in the world of geometry as a curiosity. For example, children often are taught to construct a Möbius strip from a piece of paper. A traditional method for creating a Möbius strip includes cutting a strip of paper, e.g., about an inch wide and a foot long, putting a half-twist in the strip, then joining the two ends together, e.g., with tape or other adhesive. In that way, one can turn a two-sided strip of paper into a one-sided Möbius strip.

Though the child's paper strip illustrates the concept of the Möbius strip, the method used to create it results only in a crude form of a Möbius strip. For example, that method produces a strip with a prominent seam which degrades the illusion of a strip having an infinite surface. As such, it does not reflect the true nature of the Möbius strip.

The Möbius strip concept has been employed to construct various devices. For example, U.S. Pat. No. 4,253,836 reported use of the Möbius strip design in the construction of power transmission belts. Other patents have reported use of the Möbius strip concept in game puzzles. For example, U.S. Pat. No. 4,384,717 discloses a puzzle comprising two Möbius strip loops linked together to form a composite M öbius strip. See, also, U.S. Pat. No. 5,324,037, for its report of a game puzzle in the form of a Möbius strip comprising multiple columns and rows of block-like pieces.

The Möbius strip concept has potential for use in a variety of applications. However, in order to produce a high quality Möbius strip, e.g., for use as a retail item, notable challenges are presented in terms of manufacturing. As noted above, it is critical for the final product to be as seamless as possible. Additionally, it often is desirable for the Möbius strip to have printed matter on it. In that case, the alignment of the printing of the strip is critical in creating the illusion of a never-ending image. There are no printing machines that can readily adapt to the unique challenges presented in creating a high quality Möbius strip in a cost-effective manner.

Thus, it would be desirable to have new methods for manufacturing Möbius strips. It would be highly desirable to develop such methods to create a relatively seamless Möbius strip which can be printed on at least one side prior to final construction. Such methods would be useful for the construction of Möbius strips for use in a variety of retail items, such as puzzles, gift and other novelty items.

SUMMARY OF THE INVENTION

I have discovered novel methods for the one-sided printing and manufacture of a Möbius strip, which include a pre-assembled Möbius strip and both a single-piece puzzle and a multi-piece puzzle. Methods of the invention may be used to create a relatively seamless Möbius strip when assembled.

Methods of the invention are particularly suited for the one-sided printing and manufacture of Möbius strips for use in a variety of retail items, such as puzzles, gift and other novelty items, and for use as a marketing tool.

In particular, methods of the invention comprise creating a printable rectangular image which may optionally contain color, words or other graphics which are continuous. That is, the left end of the image aligns with the right end of the image to produce a 360° image; arranging three substantially identical copies of the image such that one copy is juxtaposed to a second copy and a third copy is centered beneath and adjacent to the first two copies; printing this composite image on a material suitable for use as a Möbius strip, preferably having an adhesive backing protected by a removable liner; setting a die layout in a desired configuration; and die-cutting the Möbius strip in the desired design. Assembly of the Möbius strip generally comprises removing the liner from the adhesive; folding the die-cut piece along a score that runs across the middle of the piece so that the top and bottom halves adhere to one another; rotating one end of the strip about 180°; and joining the two ends of the strip by aligning the two ends so that they match, thus joining the remaining exposed adhesive to form a twisted closed loop.

While preferred embodiments of the invention comprise use of a printed image, the strip also may be created without graphics, in which case, only the die-cutting and folding methods would apply.

Methods of the invention may be used to produce Möbius strip puzzles, e.g., one-piece type puzzles or multi-piece puzzles. Such puzzles may be constructed in many different configurations, and may optionally contain color, or a printed or graphic image as described above.

Other aspects of the invention are disclosed infra.

DETAILED DESCRIPTION OF THE INVENTION

As noted above, the present invention provides novel methods for the one-sided printing and manufacture of a M öbius strip. Using methods of the present invention, seamless, high quality Möbius strips can be produced for use in a wide variety of retail items.

Figure 1A:
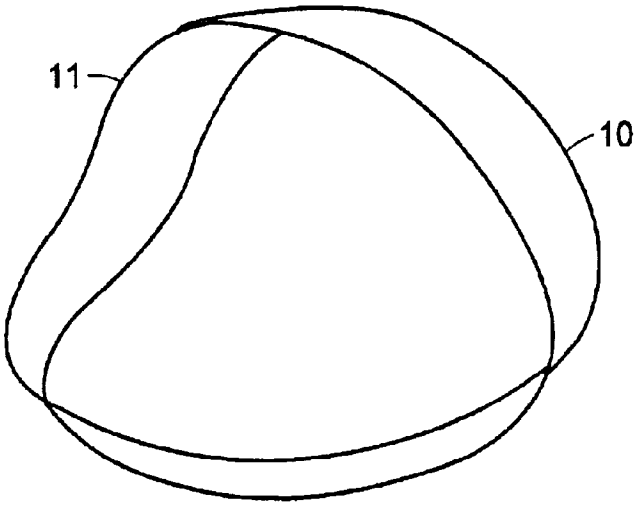
FIG. 1A shows a rectangular strip suitable for use in constructing a Möbius strip.
Figure 1B:
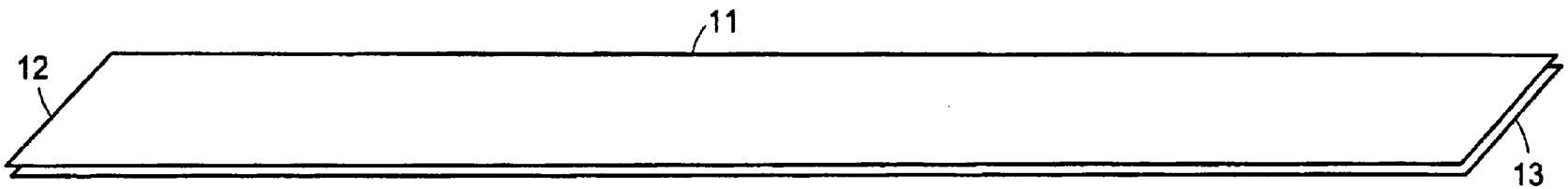
FIG. 1B shows a typical assembled Möbius strip.

Referring to FIGS. 1A–1B, a typical Möbius strip 10 is shown as a continuous one-sided surface that can be formed from a rectangular strip 11 by rotating one end 12 180° and attaching it to the other end 13. As can be seen from the illustration, when traversing the surface of a Möbius strip, the surface "flips". For example, what used to be the back of the strip of paper becomes the front and the front becomes the back. Thus if one were to draw a line down the middle of a Möbius strip starting at any point, upon completing one revolution around the object, the pen tip would arrive at the point of origin, but on the other side of the strip; a second revolution around the strip has to be completed before the pen returns to the point of origin on the original "side" of the strip.

In a first aspect of the invention, the Möbius strip preferably comprises printed matter, e.g., text, wording and the like, on one side of the strip prior to its construction. In that way, the printed matter appears right side up on one side and upside down on the other side. The strip can then be joined together at its respective ends with a half-twist to form a continuous, closed system concept. This aspect of the invention is illustrated in the embodiments denoted by reference numerals 14 and 15 in FIGS. 2A–2B.

Figure 2A:
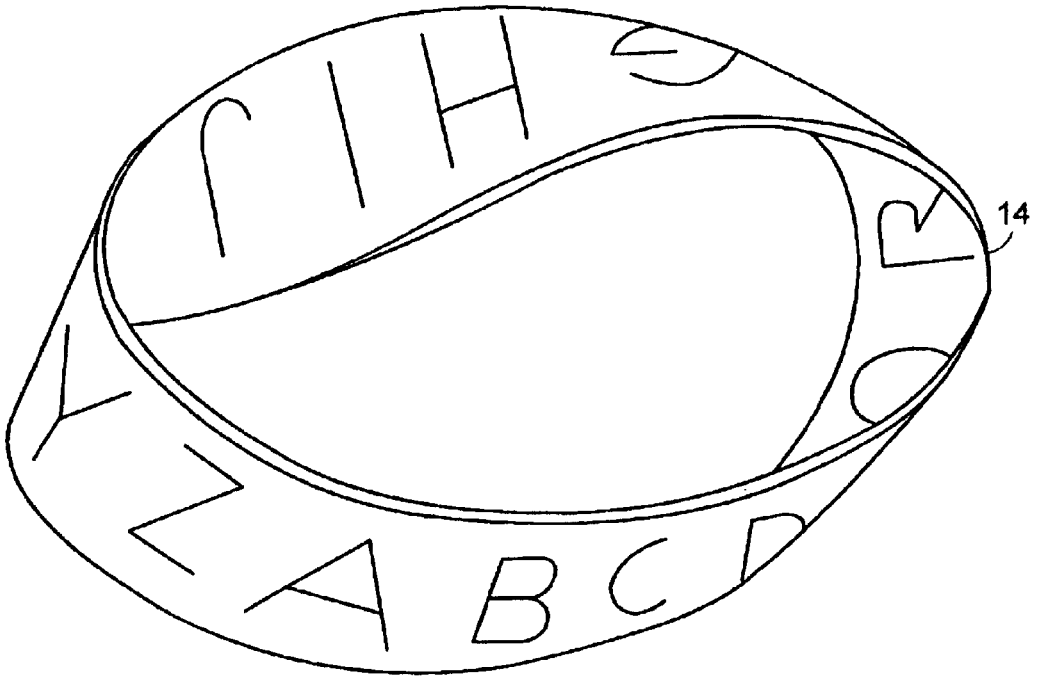
FIGS. 2A–2B show two assembled Möbius strips, each bearing a different printed image, in a preferred embodiment of the invention.
Figure 2B:
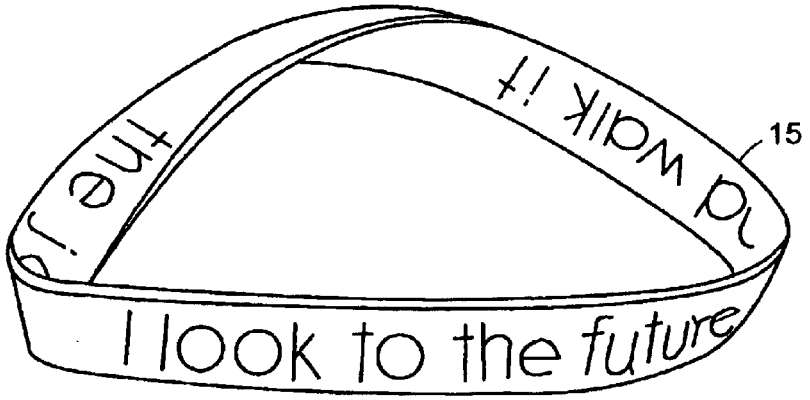

As shown in FIG. 2B, , the use of poetry may be employed in constructing a Möbius strip in accordance with the methods of the invention. This concept of continuous text in the form of poetry is referred to herein as INFINITE POETRY.

The format of INFINITE POETRY is quite simple. There are two principle rules to be followed in creating INFINITE POETRY:

1. The poem must be constructed in such a way that the concepts it contains flow in a logical sequence from one passage to the next and logically go back to the "first" concept.

2. It should also have no official beginning. That is, the reader must be able to start at any line.

An example of INFINITE POETRY follows:

. . . I look to the future
I see many roads
I weigh each possibility
I choose a road and walk it
I learn from the journey
I look to the future . . .

By convention, the "first" line of the poem is repeated at the end so that the conceptual loop is closed. An ellipsis typically is placed before the first line and at the end of the last line.

The second rule of INFINITE POETRY is not absolute. One can have an infinite poem that is a closed system while still having a unique starting point.

For instance, a second example of INFINITE POETRY follows:

. . . Chris is a wonderful, wonderful name each time that you say it, it's never the same you can whisper it soft, you can shout it out loud if you say it in public, it draws quite a crowd because Chris is a wonderful, wonderful name . . .

In this instance, while you could start from any line in the poem, it is preferable to start with the "first" line.

Methods of the invention are not limited to Möbius strips comprising letters, words and other text. In a second aspect of the invention, circular images or other graphics, such as those created using a 360° panoramic camera, also may be printed onto a Möbius strip, creating the illusion of a continuous picture that traverses two sides of this "one-sided" object.

Methods of the invention for creating a relatively seamless Möbius strip, which optionally may be printed on one side before final construction, are described below.

For the purpose of illustrating the printing and manufacturing methods of the invention, the construction of only a single Möbius strip will be described. However, it will be appreciated by those skilled in the art, that the images can be duplicated numerous times on a single sheet or can be printed repeatedly off a roll or in sheets.

First, a suitable material for the Möbius strip is selected. A particularly preferred material is ten-mil clear polycarbonate (commercially available from TEKRA Corporation). Several other commercially available materials work well for this purpose. For example, rigid vinyl having a thickness of about five to ten mil, or plasticized paper, and the like also are generally preferred. Even ordinary paper labels with adhesive (commercially available in sheet form from Avery Dennison Corporation) can be used to create a Möbius strip in accordance with the invention. Generally, any material upon which printing can be applied and which can accept some kind of adhesive on one side will perform quite well in this manufacturing method.

Polycarbonate having a thickness of approximately ten-mil has the advantage of being slightly stiff. When the M öbius strip is fully constructed, this property gives the strip its classic "infinity" shape. Other materials with less rigidity do not maintain the figure-of-eight shape. More rigid materials do not bend enough to assume the shape of the Möbius strip or pull against the adhesive to separate the loop.

A preferred adhesive for the manufacturing process is 467MP Hi Performance Adhesive or Stamark Laminating Adhesive (both commercially available from 3M). This adhesive can be placed on the strip material before printing in the case where the printing is done on the exposed surface of the Möbius strip. Alternately, the adhesive can be placed on the material after printing in the case where the printing is done on the back surface of the Möbius strip, e.g., printed in reverse to show through to the exposed, textured side. This adhesive preferably has a protective layer which covers the adhesive until the strip is ready for assembly.

In accordance with the methods of the invention, the image is then designed and a layout set. As noted above, the image may optionally comprise color, text or graphics, or it may be essentially blank. Several steps are employed in order to properly align the image onto the strip material before die-cutting and final assembly/construction of the M öbius .

Using methods of the invention, the full-length image is designed without regard to placement on the strip material. For example, referring with particularity to FIG. 3, the image 16 should be designed in such a way that the graphics at the left end of the text or graphic image 17 align with the right end of the image 18. That is to say, if two copies of the image were juxtaposed, the side-by-side images would create a single, continuous, and seamless image.

It will be appreciated that the dimensions can vary considerably to create Möbius strips of differing widths and lengths. Methods of the invention may be employed in constructing Möbius strips of all sizes. In general, in order to create a balanced-appearing Möbius strip, a preferable width to length ratio for the strip material will be between about 1:20 and about 1:30, more preferably, between about 1:20 and about 1:24, most preferably a ratio of about 1:24. Thus, a Möbius strip that is one inch wide will be optimally 24 inches in "length" (if one considers the length of the M öbius strip to be measured from one point on one side until that point is arrived at again when traversing the strip). For purposes of illustration, a representative image 16 is shown as a single line of text, e.g. letters of the English alphabet, in FIG. 3.

Figure 3:
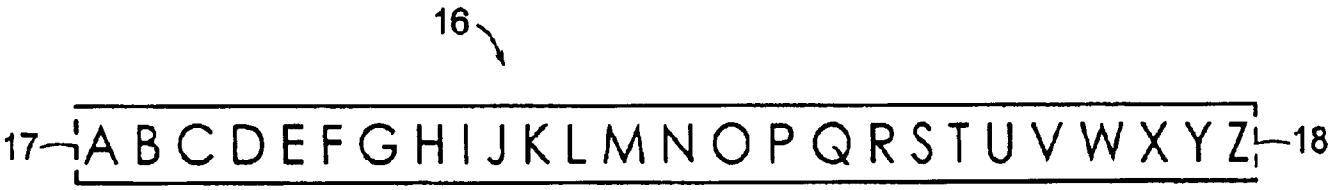
FIG. 3 shows a representation of a printed image to be applied to a Möbius strip.
Figure 4:
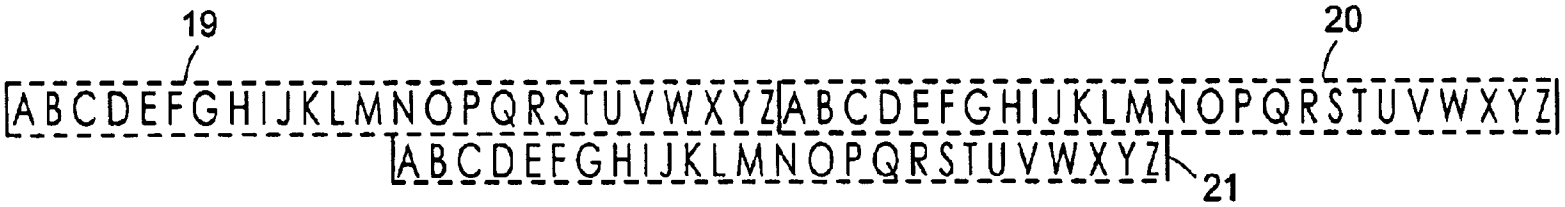
FIG. 4 shows the layout of three copies of the image of FIG. 2 for use in constructing a single Möbius strip.

Referring now to FIG.4, three substantially identical copies of the image shown in FIG. 3 are arranged in such a way that two copies 19 and 20 are juxtaposed (e.g., the right side of a first copy of the image is adjacent to the left side of a second copy of the image), and a third copy 21 is centered directly below and adjacent to the other two copies.

Figure 5:
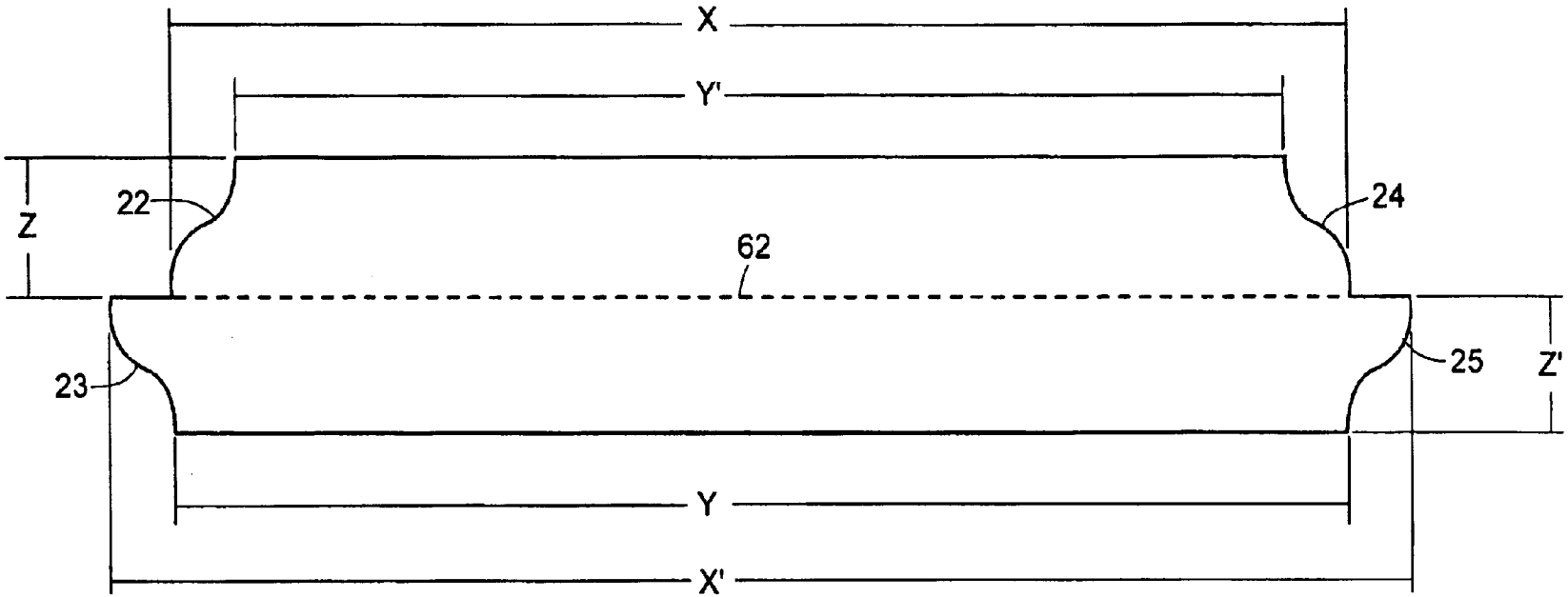
FIG. 5 shows a die layout in a preferred embodiment of the invention.

The die design for cutting out the Möbius strip after printing is illustrated in FIG.5. The four sigmoid-shaped ends of the die 22, 23, 24 and 25 can be of any general curvature, depending upon the application. Generally, the ends are designed so that they will align in such a way that the top left side 22 matches the bottom right side 25. For example, the respective ends should fit together as would the edges of two jigsaw puzzle pieces. Similarly, the top right side of the design 24 must match the bottom left side 23 of the design.

The dimensions of the die are based upon the original image dimensions. Again referring to FIG. 5, the image length must equal the combined lengths x and y. The image length must also equal the combined lengths x' and y'. By derivation, the combined lengths of x and y must equal the combined lengths of x' and y'. The height of the image should be equal to length z and length z'.

The die also includes a scoring edge through the horizontal center of the die, preferably on the non-adhesive side of the strip material. This score is illustrated in FIG. 5 as a dashed line 62.

Figure 6A:
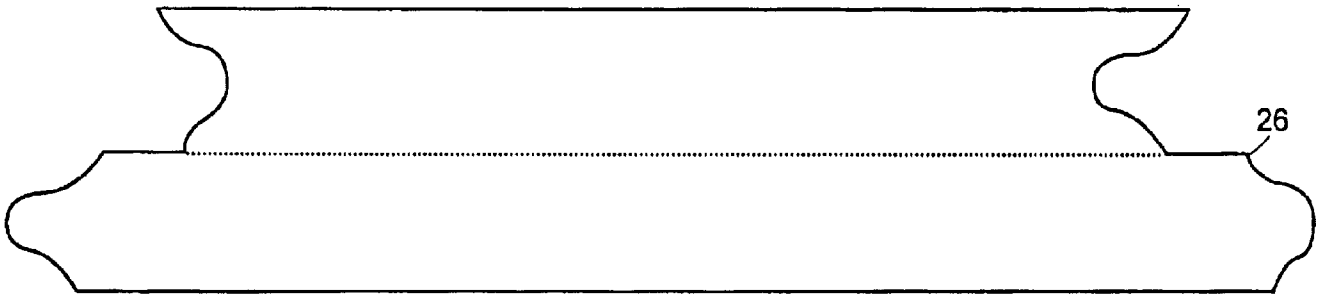
FIGS. 6A–6C show three other die layouts for alternate preferred embodiments of the invention.
Figure 6B:
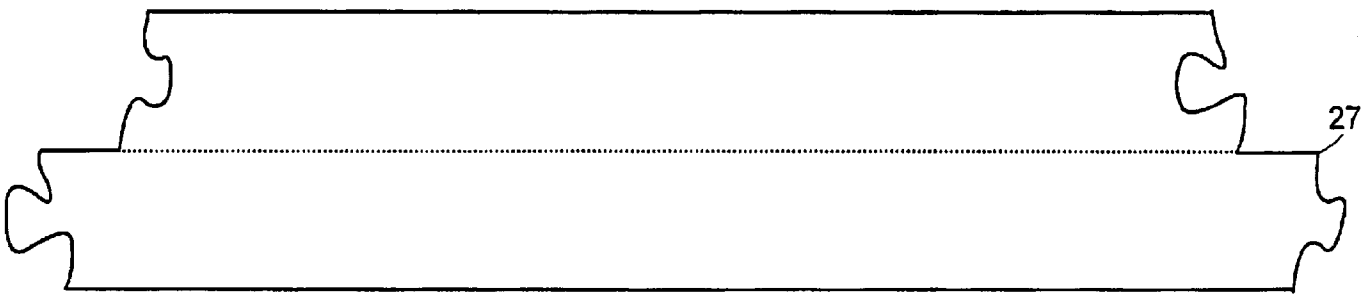
Figure 6C:
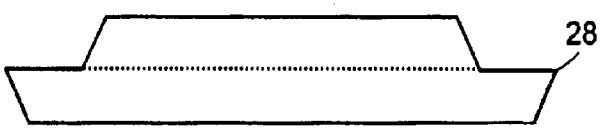

FIGS. 6A–6C show three alternate configurations of the ends of the die. FIG. 6A shows a design embodiment 26 that is ideal for a Möbius strip that is pre-assembled during the manufacturing process. This particular shape provides an optimal seam for final construction that holds up well against repeated twisting and scrolling of the Möbius strip.

FIG. 6B shows a "one-piece puzzle" embodiment 27 of a Möbius strip that uses shapes that are akin to jigsaw puzzle pieces. This Möbius strip can be assembled and solved by a person with no prior knowledge of the solution using intuition, trial and error, or by following the following three simple instructions:

1. Remove the adhesive backing.
2. Fold the puzzle piece in half along the score.
3. Join the two ends together by creating a loop with a half twist.

FIG. 6C shows a die configuration 28 having essentially generic ends; this particular configuration is designed proportional to the image layout described previously and illustrated in FIG. 4. Once the image has been placed on the material, it is cut using the die configuration shown in FIG. 6C.

Figure 7A:
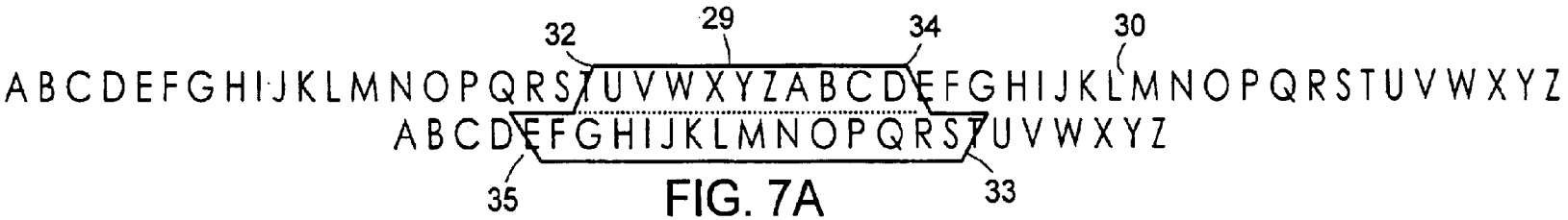
FIG. 7A shows a layout of the die from FIG. 5C over the image sections of FIG. 3.
Figure 7B:
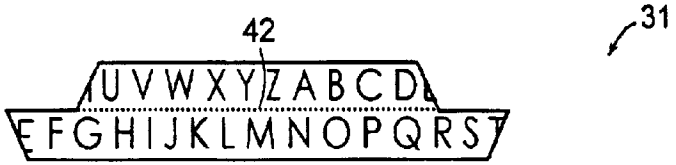
FIG. 7B shows the resulting die-cut image.

Referring now to FIG. 7, the alignment of the die 29 to the image 30 is illustrated in FIG. 7A. FIG. 7B illustrates the resulting product of the die-cutting process denoted by reference numeral 31. It will be appreciated by those familiar with the art that a goal of the manufacturing process is to minimize wasted materials. Therefore extraneous materials, e.g., those materials which are well outside the bounds of the die-cutting process, would not in fact be printed. The process of aligning the images would be the same. However, the images would be cut off just beyond the tolerances of error for the die-cutting process.

Referring again to FIG. 7B, it is noted that the "T" bisected by the upper left die cut 32 matches exactly with the "T" bisected by the lower rig die cut 33. Similarly, the "E" bisected by the upper right die cut 34matches exactly with the "E" bisected by the lower left die cut 35. This exact alignment resulting from the method described allows for this shape to be assembled into a seamless Möbius strip.

Figure 8A:
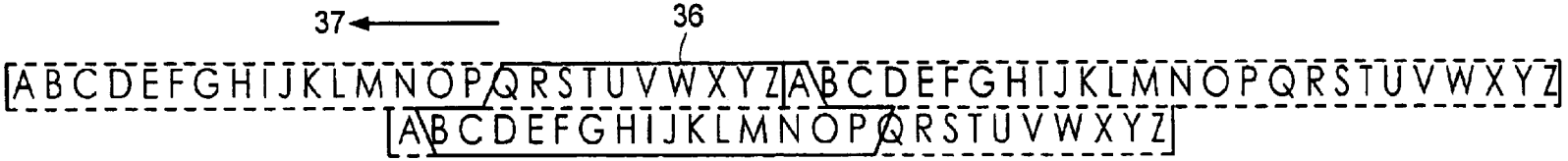
FIG. 8A shows the die shifted to the left in the die-cutting process.
Figure 8B:
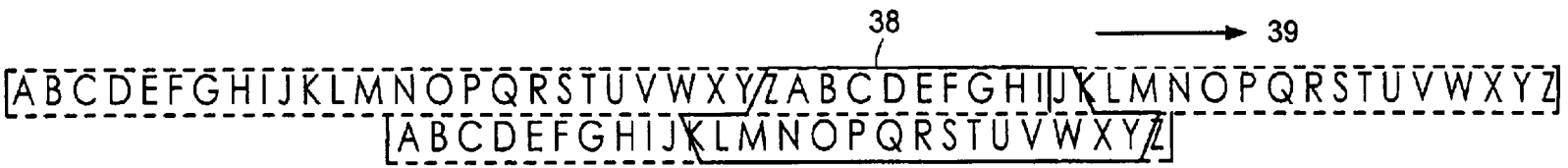
FIG. 8B shows the die shifted to the right in the die-cutting process.

It will be appreciated by those familiar with the art that any printing process which includes die cutting must tolerate some degree of error in accuracy of the die cut. The methods of the invention as described herein allow for wide tolerances side-to-side as illustrated in FIGS. 8A and 8B. For example, in shifted to the extreme left of the image 37. Similarly, in FIG. 8B the die 38 is shifted to the extreme right of the image 39. While the degree of error illustrated in these two examples is highly unlikely during the manufacturing process, it nevertheless shows that in both cases, the die would cut out precisely one complete image. As shown in these examples, all letters of the alphabet are represented exactly once.

Figure 9:
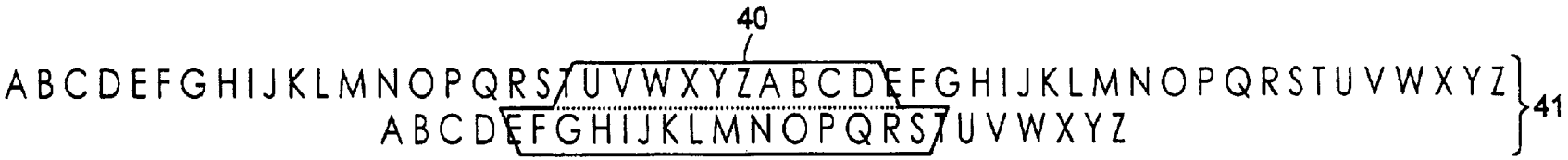
FIG. 9 shows the die shifted up in the die-cutting process.

Tolerance for errors which may occur up and down during the die cutting process may be accommodated by creating an original image that is slightly longer in height than the dimensions z and z' illustrated in FIG. 5. It is appreciated by those familiar with the art that incorporating a "bleed" beyond the die cut will ensure that the final product will have print on the entire piece. FIG. 9 illustrates a shift of the die 40 up slightly relative to the composite image 41. As shown in this illustration, the letters "T" and "E" are still bisected by the die at either end so that no portion of either letter is contained more than once. Thus, the method accommodates up and down errors in die registration.

Figure 10A:
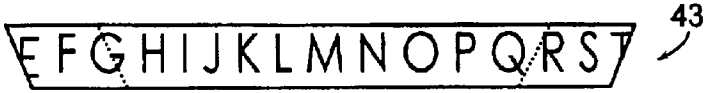
FIGS. 10A–10B show a folded strip, front and back, respectively.
Figure 10B:
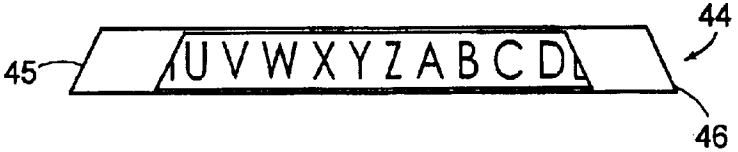

To complete construction of the Möbius strip, the protective layer covering the adhesive is peeled away from the strip material to expose the adhesive backing. Referring again to FIG. 7B, the strip is folded horizontally along the score line 42. Pressure is applied to the joined ends, e.g. top and bottom, of the strip. The resulting unassembled Möbius strip is shown, front view 43 in FIG. 10A and back view 44 in FIG. 10B.

The resulting piece has two ends of exposed adhesive 45 and 46. After rotating one end 180°, the two ends are brought together in the twisted loop of a Möbius strip and sealed together with pressure.

The final product is a Möbius strip similar to that illustrated in FIGS. 1A and 2A–2B. Using methods of the invention, a Möbius strip is created whose printing is perfectly aligned and whose seam is difficult to detect. The thickness of the strip does not vary, even over the seam; every part of the Möbius strip consists of two layers of adhesive in between two layers of the printed material. The relatively seamless strip provides a significantly better illusion of an infinite image than the traditional method for fashioning a Möbius strip. Because the printing method involves only one-sided printing, it also is significantly more cost-effective than a method requiring two-sided printing.

Figure 11A:
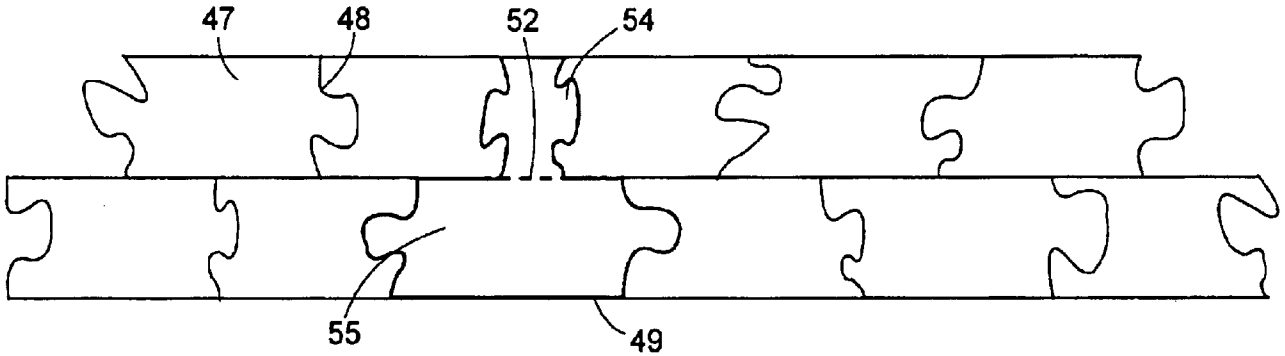
FIGS. 11A–11E show a jigsaw-like, multi-piece puzzle M öbius strip in partially disassembled and assembled formats.
Figure 11B:
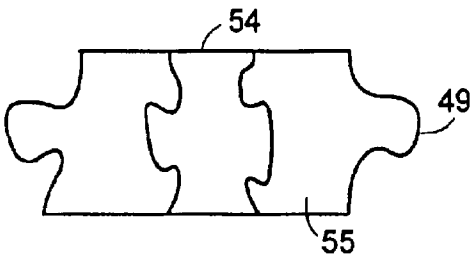

In yet another aspect of the invention, methods of the invention may be used to construct a multi-piece Möbius puzzle as shown in FIGS. 11A–11E. As illustrated in FIG. 11A, the Möbius strip material is arranged in a similar manner as the one-piece puzzle. In this aspect of the invention the material is die-cut into several pieces, e.g., such as that denoted by reference numeral 47, having a jigsaw-like edge 48. A key piece, denoted by the bold outline 49, is created. As used herein, the term "key piece" refers to a puzzle piece which is unique relative to the other puzzle pieces, without which the remaining puzzle pieces cannot be joined together to form a closed loop. In particular, key piece 49 is unique in that it is a combination of the center pieces 54 and 55 from the upper and lower rows of the Möbius strip. The key piece is folded at a transverse median score line 52 (similar to that described in the one-piece Möbius puzzle). The resulting piece, illustrated in FIGS. 11A and 11B, consists of the top half 54 inversely positioned on the bottom half 55. One half of the key piece is typically wider than the other half. When material which has adhesive on one side is used to construct this puzzle, the adhesive on piece 55 will overlap piece 54 to create the key piece 49 on which the other pieces can be added. As in the other preferred embodiments of the invention, the multi-piece M öbius puzzle may optionally comprise color, or a printed or graphic image.

Figure 11E:
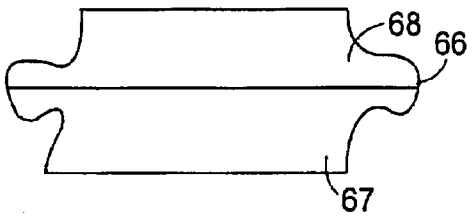
Figure 11C:
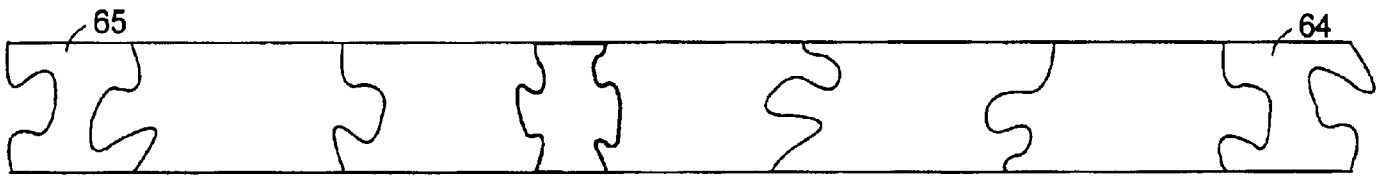
Figure 11D:
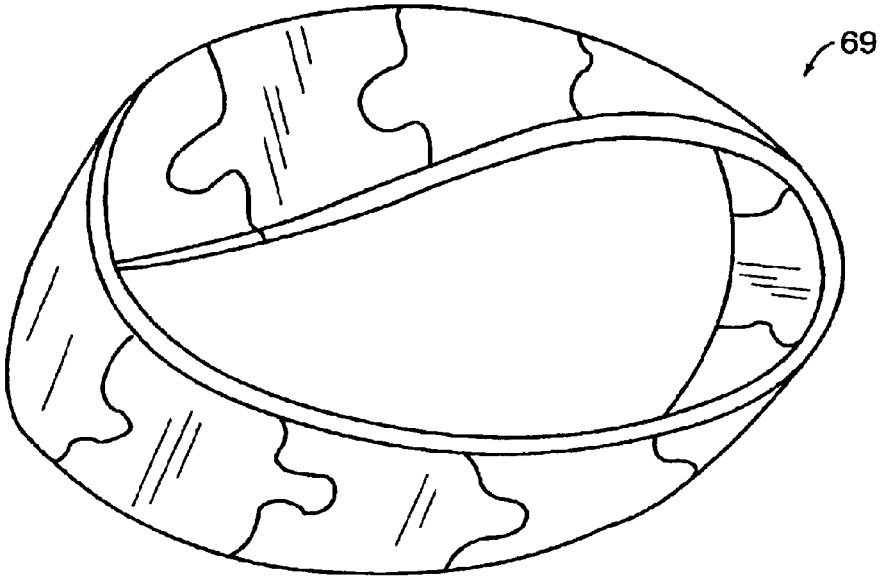

To solve the puzzle, the remaining pieces are attached one at a time to the key piece 49 until all the pieces have been combined into a single, two-sided chain, shown in FIG. 11C. The puzzle is then solved by turning the strip of pieces into a loop with a half twist and joining the remaining exposed adhesive 64 and 65, thus creating a Möbius strip as shown in FIG. 11D denoted by reference numeral 69.

If a strong adhesive is used, the puzzle can be solved only once. Alternatively, as illustrated in FIG. 11E, hook and loop fasteners denoted by reference numerals 67 and 68 (available commercially from 3M or Velcro) can be placed on the back of each puzzle piece 66. Preferably, the hook fasteners are provided on the bottom half of the image and loop fasteners are provided on the top half of the image on all pieces. The key piece should be permanently bonded together using an epoxy or other commercially available adhesive, though it too should be layered with hook and loop fasteners so that it will maintain the same thickness relative to the other pieces.

By using hook and loop fasteners in the manner described, the upper and lower halves of the puzzle will bond to one another when placed back to back. The puzzle can then be pulled apart and solved repeatedly.

Figure 12A:
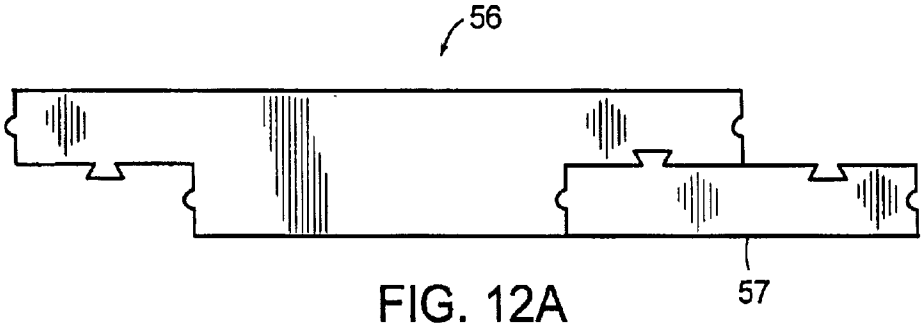
FIGS. 12A–12E show two alternate embodiments of a multi-piece puzzle Möbius strip in partially disassembled and assembled formats.
Figure 12B:
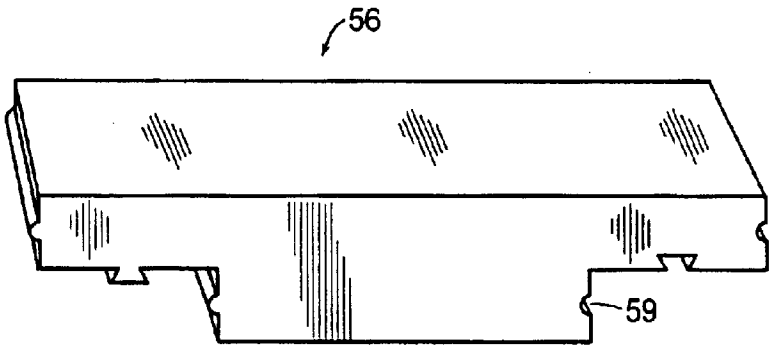
Figure 12C:
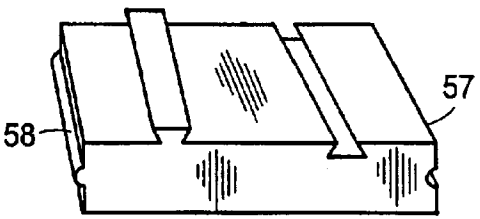

Yet another aspect of this invention is to create a similar multi-piece puzzle using solid, flexible plastic or rubber pieces such as that shown in FIGS. 12A–12C. In this particular embodiment, key piece 56 and a representative additional piece 57 are shown in both assembled and unassembled formats. In one preferred embodiment, these pieces contain tongue-and groove-type fasteners, denoted by reference numerals 58 and 59 respectively, that can be joined together as shown in the illustration of FIG. 12A. It will be appreciated by those familiar with the art that these connections may be created in any number of shapes and configurations. This puzzle may be solved in a similar fashion to the other multi-piece puzzles already described.

Figure 12D:
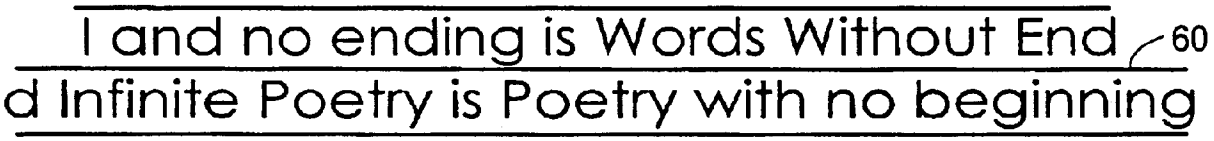
Figure 12E:
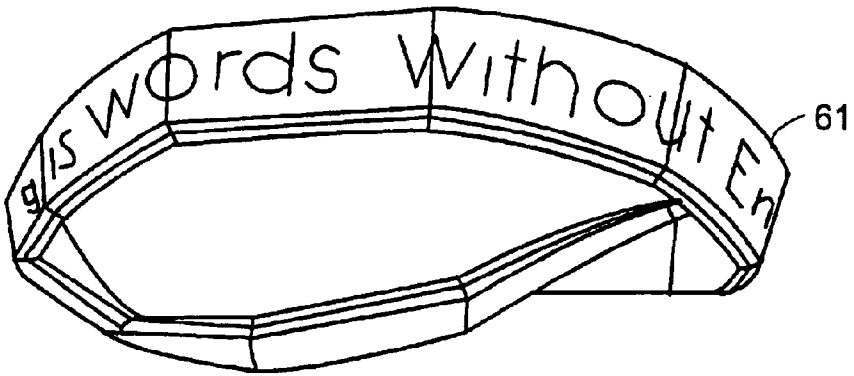

To create different challenges to the puzzle, the pieces can all be made identical to one another with the exception of a suitable key piece. Referring to FIGS. 12D–12E, the person solving the puzzle must rely on arranging the image on its surface in order to solve it. (See, e.g., a representative image 60 in FIG. 12D and solved Möbius puzzle 61 in FIG. 12E.) Alternatively, each piece could have a unique tongue-and-grove configuration, such that each piece has only one position in the chain in which it will fit.

While generally less preferred, a simple Möbius puzzle may be designed and constructed in accordance with the methods of the invention without the need for a key-piece or other piece of a unique design.

Still another aspect of this invention is to employ the methods of the invention in the creation of a software version of the manufacturing process. This aspect of the invention is essentially consistent with the above methods except that an image is created using a suitable software application; the image is then printed out from a computer. This application may be practiced even by a consumer using a home computer. For example, the consumer can easily purchase sheets of material that are suitable for use with a home printer. Such material is preferably pre-cut and scored with the appropriate die configuration and is capable of producing several Möbius strips on a single sheet. As is commonly seen in printable labels which may be fed through a printer, a perforation is made on one side of the sheet to permit facile removal of the strips from the sheet material. In summary, the software configures the image, e.g., graphic design, so that it aligns with the Möbius strips on the sheet. The resulting printed Möbius strips can then be removed and assembled as previously described. It will be appreciated by those skilled in the art that this particular aspect of the invention may performed on a production-scale level quite easily.

The terms and expressions which have been employed herein are used as terms of description and not of limitation. There is no intent, in the use of such terms and expressions, of excluding any of the equivalents of the features shown and described or portions thereof, but it is recognized that various modifications are possible within the scope of the invention claimed.

What is claimed:

1. A method for the manufacture of a Möbius strip comprising the steps of:

(a) providing an image on a material suitable for construction of the Möbius strip;

(b) aligning three substantially identical copies of the image such that a first copy is juxtaposed to a second copy, and a third copy is centered beneath and adjacent to the first and second copies;

(c) setting a die layout to produce the image in a desired configuration on the Möbius strip;

(d) die-cutting the copies of the image; and (e) assembling the die-cut copies or the image to form the Möbius strip.

2. The method of claim 1 wherein the image optionally comprises color, lettering, text, or other graphics.

3. The method of claim 1 wherein the image is substantially blank.

4. The method of claim 1 wherein the image is printed on a material having an adhesive on one side.

5. The method of claim 4 wherein the adhesive is in contact with a removable liner.

6. The method of claim 1 wherein assembling the Möbius strip comprises folding the die-cut Möbius strip along a central score line; rotating one end of the strip about 180°, and joining the two ends of the strip.

7. The method of claim 1 wherein the die layout produces a die-cut image having curved ends.

8. The method of claim 1 wherein the die layout produces a die-cut image having ends that fit together in a puzzle-like manner once the Möbius strip is assembled.

9. The method of claim 1 wherein step (c) comprises die-cutting exactly one copy of the image from the three juxtaposed images in a configuration that, when assembled, provides a substantially seamless Möbius strip having a continuous image thereon.

10. A method for the manufacture of a multi-piece Möbius puzzle comprising the steps of:

(a) aligning an image on one side of a rectangular strip material suitable for construction of the Möbius puzzle;

(b) arranging three substantially identical copies of the image such that a first copy is juxtaposed to a second copy and a third copy is centered beneath and adjacent to the first and second copies;

(c) setting a die layout in a configuration for producing multiple puzzle pieces of the Möbius puzzle;

(d) die-cutting the strip material in the configuration of (c); and (e) creating a key piece from two center pieces, onto which the rest of the multiple puzzle pieces are assembled to produce the Möbius puzzle.

11. The method of claim 10 wherein the image optionally comprises color, lettering, text, or other graphics.

12. The method of claim 10 wherein the image is substantially blank.

13. The method of claim 10 wherein the strip material comprises an adhesive on one side.

14. The method of claim 10 further comprising assembling the multiple puzzle pieces to solve the Möbius puzzle.

15. The method of claim 10 wherein the multiple puzzle pieces have a jigsaw-like edge.

16. The method of claim 10 wherein the multiple puzzle pieces have a straight or curved edge.

17. The method of claim 10 wherein the multiple puzzle pieces are attached to the key piece to form a single two-sided chain.

18. The method of claim 10 wherein the Möbius puzzle comprises hook and loop fasteners.

* * * * *